US005094559A

United States Patent [19]

Rivera et al.

[11] Patent Number: 5,094,559

[45] Date of Patent: Mar. 10, 1992

[54] DISPOSABLE CLEANING PAD AND METHOD

[75] Inventors: Ligia A. Rivera, New Brunswick; Charles E. Buck, Caldwell; Robert C. Roga, Spotswood, all of N.J.

[73] Assignee: Colgate-Palmolive Company, Piscataway, N.J.

[21] Appl. No.: 171,570

[22] Filed: Mar. 22, 1988

Related U.S. Application Data

[62] Division of Ser. No. 861,904, May 12, 1986.

[51] Int. Cl.[5] ..... B43K 5/14

[52] U.S. Cl. ..... 401/132; 401/140; 401/196; 401/201

[58] Field of Search ..... 401/130, 132, 187, 196, 401/264, 266, 268, 272, 283, 290; 15/104.93, 104.94, 147 R, 147 A, 228, 244.1, 244.2, 244.3, 244.4

[56] References Cited

U.S. PATENT DOCUMENTS

| | | | |
|---|---|---|---|
| 1,669,293 | 5/1928 | Grossmann | 15/244.1 X |
| 2,301,586 | 11/1942 | Rubin | 15/147 A |
| 2,691,788 | 10/1954 | Thomasson | 15/244.1 |
| 2,790,982 | 5/1957 | Schneider | 401/132 X |
| 3,041,651 | 7/1962 | Jardine | 15/244.1 |
| 3,053,385 | 9/1962 | Spees | 401/132 X |
| 3,060,486 | 10/1962 | Lewis | 401/132 |
| 3,217,353 | 11/1965 | Karcher, Jr. | 15/104.94 |
| 3,485,562 | 12/1969 | Hidden et al. | 401/196 X |
| 3,590,414 | 7/1971 | Gores | 401/196 X |
| 3,635,567 | 1/1972 | Richardson, Jr. | 401/132 |
| 3,636,922 | 1/1972 | Ketner | 401/132 X |
| 4,455,705 | 6/1984 | Graham | 15/244.2 X |

*Primary Examiner*—V. Millin
*Assistant Examiner*—D. F. Crosby
*Attorney, Agent, or Firm*—Richard J. Ancel; Robert C. Sullivan; Murray M. Grill

[57] ABSTRACT

A cleaning device having a pad having a scrubber layer of porous material, a liquid impervious sheet or surface substantially covering a rear surface of the scrubber layer, a blotter layer of absorptive material extending over the sheet or surface on a side opposite the scrubber layer, and a rupturable packet containing a liquid active material associated with the scrubber layer. The device has an instrument having a head attached to an elongated handle, and a device for releasably attaching the head to the scrubber layer and blotter layer.

1 Claim, 4 Drawing Sheets

FIG. 1
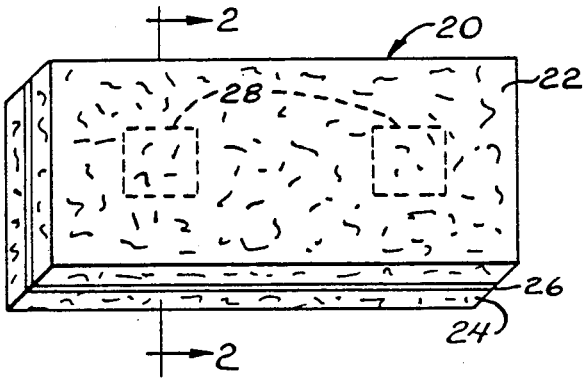
FIG. 2
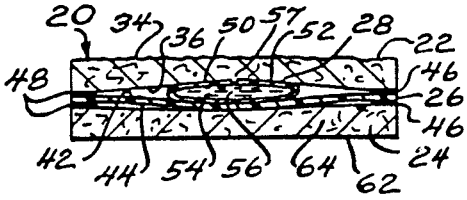
FIG. 3
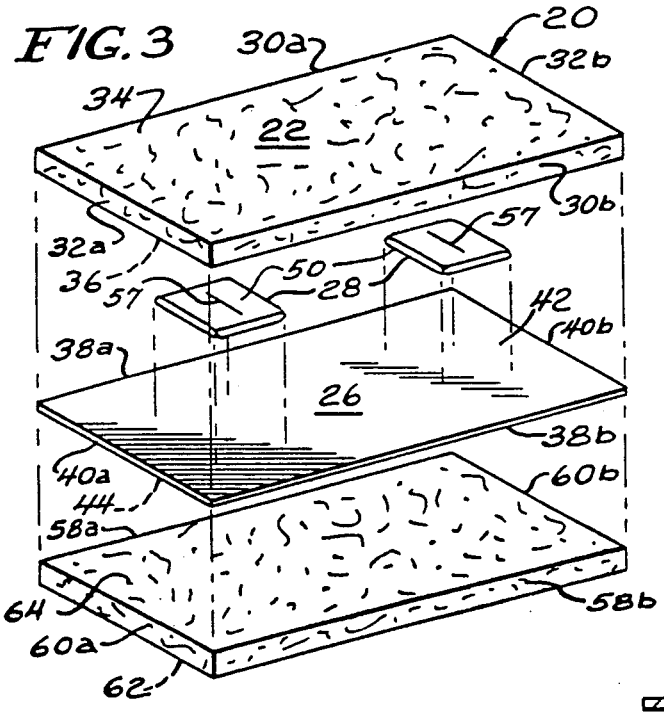
FIG. 5
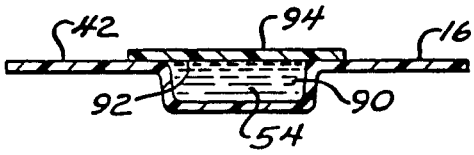
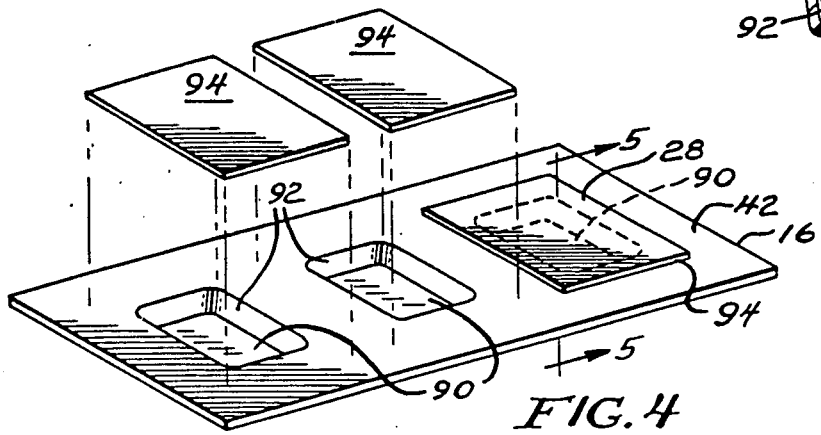
FIG. 4

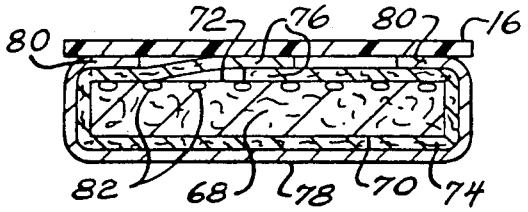
FIG. 6
FIG. 7
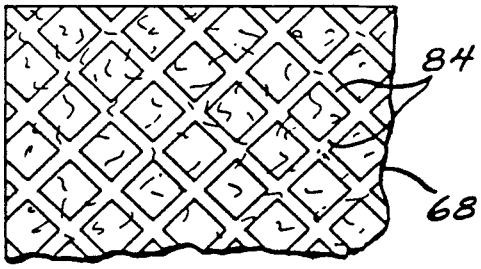
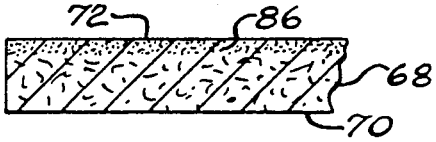
FIG. 8
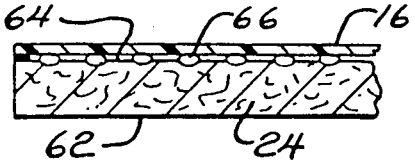
FIG. 9
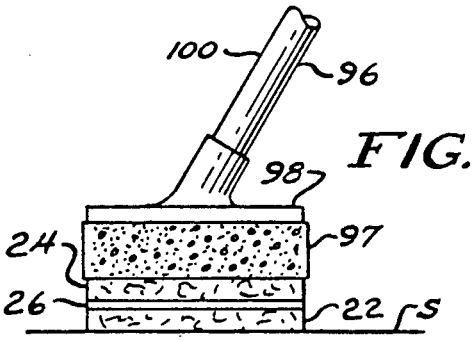
FIG. 10
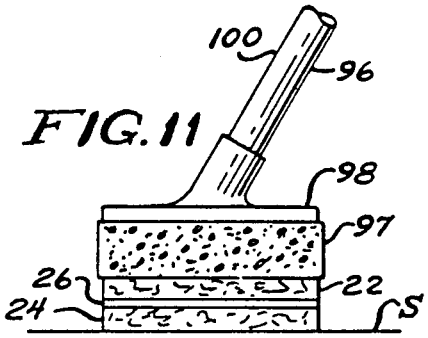
FIG. 11
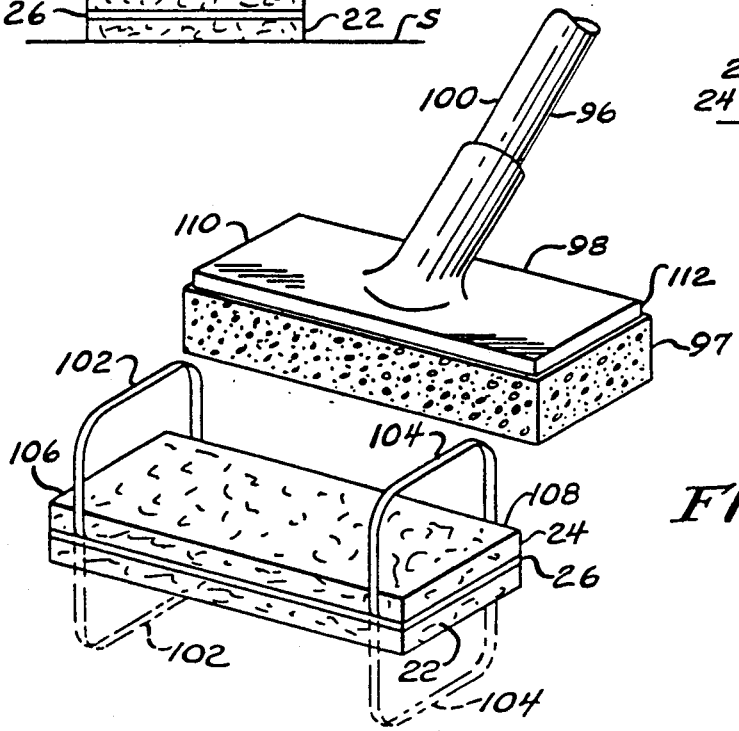
FIG. 12

FIG. 13
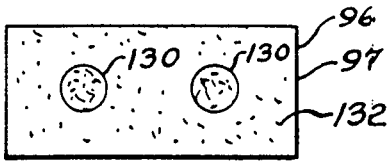
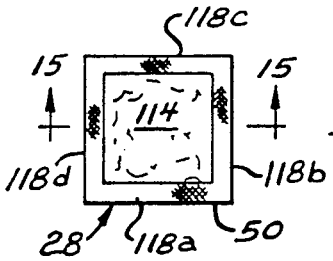
FIG. 14
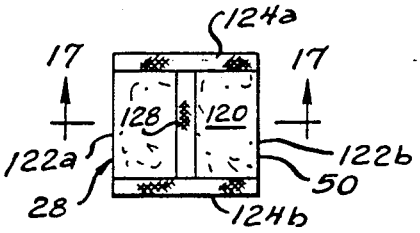
FIG. 16
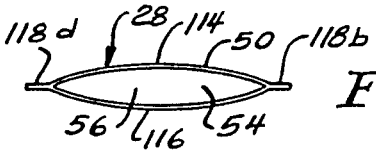
FIG. 15
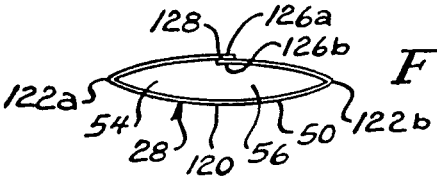
FIG. 17
FIG. 18
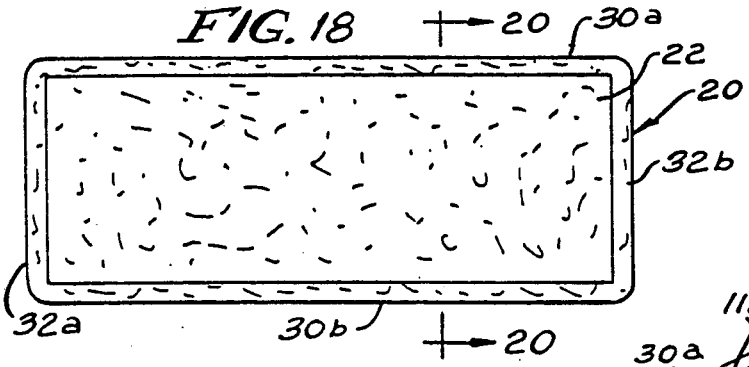
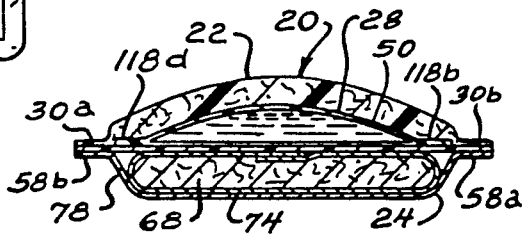
FIG. 20
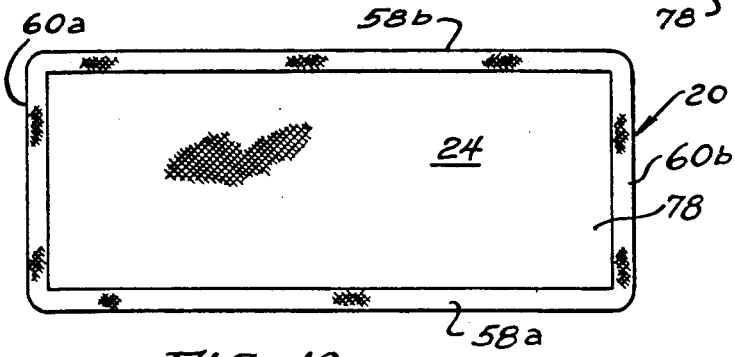
FIG. 19

DISPOSABLE CLEANING PAD AND METHOD

This is a division of application Ser. No. 861,904, filed May 12, 1986.

BACKGROUND OF THE INVENTION

The present invention relates to a disposable cleaning pad and method.

Modern surfaces, such as no-wax floors, counter tops, appliances, and ceramic tiles, are becoming increasingly more textured to provide more versatility to the decor. Homemakers have found that removing embedded soil from the depressions of textured surfaces is difficult without laborious scrubbing. For example, the no-wax floors have a textured surface with deep, wide and frequent valleys in addition to bubbles near the surface which break revealing a cavity for soil entrapment. The bakers object to storing and using the various "paraphernalia" associated with cleaning these surfaces. Rinsing is necessary to remove dirty residues, but conventional rinsing methods are not effective to remove all residues, and these methods provide an extra inconvenience. Thus, an improved system is needed to clean such soiled surfaces.

SUMMARY OF THE INVENTION

A principal feature of the present invention is the provision of an improved disposable pad for cleaning a soiled surface.

The pad of the present invention comprises, a scrubber layer of coarse, resilient, porous, flexible material with excellent wet strength to scrub a soiled surface, said scrubber layer having a front surface for contacting the soiled surface, and a rear surface. The pad has a liquid impervious sheet covering the rear surface of the scrubber layer. The pad has a blotter layer of absorptive material extending over the sheet on a side opposite the scrubber layer. The pad also has rupturable packet means containing a liquid cleaning material disposed intermediate the sheet and the scrubber layer, with the packet means containing sufficient cleaning material to saturate the scrubber layer when ruptured to clean the soiled surface.

A feature of the present invention is that the scrubber layer better penetrates into embossed areas of textured surfaces than conventional devices, such as sponge mops, to loosen embedded dirt.

Another feature of the invention is that the scrubber layer has a coarse texture and resiliency for improved mechanical soil release from the valleys of textured surfaces.

Yet another feature of the invention is that the scrubber layer is compatible with the surface to prevent scratching.

A further feature of the invention is that the scrubber layer is porous for entrapment of particulate soil.

Still another feature of the invention is that the scrubber layer is flexible to provide excellent recovery from A further feature of the invention is that the scrubber layer has excellent wet strength to prevent tearing. A feature of the present invention is that the packet means consistently breaks along a predetermined cross section to release all of the cleaning material in the same direction.

Another feature of the present invention is that the packet means contains an amount of headspace (air) to obtain desired projection of the cleaning material when the packet mean is ruptured.

Still another feature of the invention is that the packet means consistently ruptures at the same pressure level.

Another feature of the invention is that the walls of the packet means provide a barrier for the cleaning liquid and a perfume in the liquid.

A feature of the invention is that the liquid impervious sheet protects the blotter layer from getting wet while using the scrubber layer.

A further feature of the invention is that the sheet may be utilized to heat seal the scrubber and blotter layers to the sheet.

Yet another feature of the invention is that the sheet provides structural integrity and body to the pad such that the sheet provides the pad with improved sliding characteristics, and prevents rolling over of the pad when too much pressure is applied to the pad.

A feature of the present invention is that the blotter layer removes dirty liquid residue.

Still another feature of the invention is that the blotter layer provides a high absorbent capacity and rate under Another feature of the invention is that the blotter layer has a high wet strength to prevent tearing.

A further feature of the invention is that the blotter layer provides excellent sliding characteristics across wet and dry surfaces.

Yet another feature is that the blotter layer is lint and streak free.

Still another feature of the invention is that the blotter layer has high tensile strength in the machine and cross direction.

Another feature of the invention is that the blotter layer may comprise an inner core of fiberized wood pulp, and an outer layer of nonwoven material covering the inner core.

A feature of the present invention is the provision of superabsorbents associated with the blotter layer to enhance the absorptive capacity of the blotter layer.

Another feature of the present invention is that the scrubber and blotter layers may be frictionally engaged against the head of a conventional sponge mop to move the pad by the mop Yet another feature of the invention is that the pad may be releasably secured to the mop head.

A feature of the invention is that after using the blotter layer, a thin even film of moisture is left on the floor which evaporates quickly enough that the user perceives the floor to be immediately dry.

Another feature of the invention is that buckets of water are not required to clean the surface, nor disposal of dirty water.

Yet another feature of the invention is that the surface can be cleaned in less time.

A further feature of the invention is that the surface is rendered cleaner and shinier.

Another feature of the invention is that rinsing of the surface is not required.

A further feature of the invention is that it is easier to use than conventional devices.

Still another feature of the invention is that the surface may be cleaned without wetting the hands.

Yet another feature of the invention is that the surface may be cleaned without measuring liquids.

Still another feature of the invention is that the pad may be utilized to clean numerous surfaces such as no-wax floors ovens, toilet bowls, bathroom fixtures, glass, and soap scum from bathroom walls.

Thus, a feature of the invention is that the surface may be cleaned with greater convenience.

A further feature of the present invention is the provision of improved methods of cleaning a soiled surface Further features will become more fully apparent in the following description of the embodiments of this invention and from the appended claims

DESCRIPTION OF THE DRAWINGS

In the drawings:

FIG. 1 is a perspective view of a disposable cleaning pad according to the present invention;

FIG. 2 is a sectional view taken substantially as indicated along the line 2—2 of FIG. 1;

FIG. 3 is an exploded perspective view of the pad of FIG. 1;

FIG. 4 is an elevational view of a separating sheet for the pad of FIG. 1;

FIG. 5 is a sectional view taken substantially as indicated along the line 5—5 of FIG. 4;

FIG. 6 is a sectional view of a blotter layer for the pad of FIG. 1;

FIG. 7 is a fragmentary plan view of a core for the blotter layer of FIG. 6;

FIG. 8 is a fragmentary sectional view of another core for the blotter layer of FIG. 6;

FIG. 9 is a sectional view of another blotter layer for the pad of FIG. 1;

FIGS. 10 and 11 are fragmentary elevational views showing the use of a conventional sponge mop to move the pad of FIG. 12 is a perspective view of another embodiment of the pad of FIG. 1;

FIG. 13 is a plan view of a sponge mop for use with the pad of the present invention;

FIG. 14 is a plan view of another embodiment of packet ans of the present invention;

FIG. 15 is a sectional view taken substantially as indicated along the line 15—15 of FIG. 14;

FIG. 16 is a plan view of another embodiment of packet means of the present invention;

FIG. 17 is a sectional view taken substantially as indicated along the line 17—17 of FIG. 16;

FIG. 18 is a front plan view of another embodiment of the pad of the present invention;

FIG. 19 is a rear plan view of the pad of FIG. 18;

FIG. 20 is a sectional view taken substantially as indicated along the line 20—20 of FIG. 18.

DESCRIPTION OF THE PREFERRED EMBODIMENTS

Figure 21:
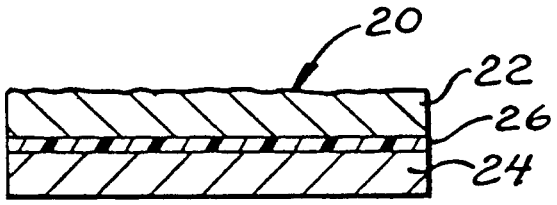
FIG. 21 is a sectional view of another embodiment of the present invention.

Referring now to FIGS. 1-3, there is shown a disposable cleaning pad generally designated 20 of the present invention. The pad 20 has an elongated scrubber layer 22, an elongated blotter layer 24 of absorptive material, an elongated liquid impervious sheet 26 intermediate the scrubber layer 22 and blotter layer 24, and rupturable packet means 28 intermediate the scrubber layer 22 and sheet 26.

The scrubber layer 22 has a pair of opposed side edges 30*a* and 30*b*, and a pair of opposed end edges 32*a* and 32*b* connecting the side edges 30*a* and *b*. The scrubber layer 22 has a front surface 34 for contacting a soiled surface, and a rear surface 36 facing the sheet 26. The scrubber layer 22 is preferably con structed from a nonwoven material which slides easily across hard surfaces to be cleaned. The scrubber layer 22 has a coarse texture and resiliency for improved mechanical soil release from valleys of textured surfaces, such as no-wax floors, when compared with conventional devices, such as sponges. The scrubber layer 22 is compatible with the surfaces to be cleaned, and is free of hard fibers or binders in the nonwoven fabric which could scratch the surfaces. The scrubber layer 22 has an open web structure such that it is porous for particulate soil entrapment during scrubbing. The scrubber layer 22 is flexible to provide excellent recovery from creasing. The scrubber layer 22 also provides for excellent liquid spreadability.

One example of a material for the scrubber layer 22 is a spray bonded nonwoven material sold under the Code No. 6952801 by Union Wadding of Pawtucket, R.I. The specifications for this material have proven to be safe and effective in cleaning soiled textured surfaces: 15 and 25 denier 100% polyester fibers bonded with 30% by weight polyvinyl chloride and a basis weight of 5.5 oz./yd.$^2$. The porous nature of this material captures particulate material, such as hairs. A further example of the scrubber layer 22 is a nonwoven material made by The Kendall Company, Boston, Mass., and identified as Bristle-tex, such as the fabric disclosed in U.S. Pat. No. 4,537,819, incorporated herein by reference. This nonwoven material is a composite structure of polyurethane foam and hydroentangled fibers. The material is a reticulated polyurethane foam containing 10 to 15 pores/inch hydroentangled with a fiber blend of 50%/50% polyester/rayon. This composite structure produces a whisker or bristle effect which penetrates deep into embossed areas or valleys of no-wax floors. Other examples of materials useful as the scrubber layer 22 are flocked foams with a heavy denier fibe flocked into a foam substrate, and bristle composites. In a pre ferred form, the scrubber layer has a basis weight of 2 to 6 oz./sq.yd. and a thickness in the range of 0.125 to 1.0 inches The thickness of the scrubber layer 22 is an important factor in cleaning performance and ease of usage. Thicker materials perform better, and eliminate possible roll over problems The liquid impervious sheet 26 has a pair of opposed side edges 38*a* and 38*b*, a pair of opposed end edges 40*a* and 40*b* connecting the side edges 38*a* and *b*, a front surface 42 facing the scrubber layer 22, and a rear surface 44 facing the blotter layer 24. The sheet 26 prevents the blotter layer 24 from getting wet while scrubbing with the scrubber layer 22. The sheet 26 provides structural integrity and body to the pad 20. When scrubbing and blotting, the film 26 facilitates sliding of the pad 20, and prevents roll over of the pad 20 when too much pressure is applied during use of the pad 20. The sheet 26 is preferably constructed from a thermoplastic material, such as low density polyethylene, such that it may be heat sealed to the scrubber layer 22 and blotter layer 24 in regions 46. Alternatively, a suitable adhesive 48 may be utilized to bond the sheet 26 to the scrubber layer 22 and blotter layer 24. The sheet 26 is constructed from a material which is not too rigid to prevent sharp, rigid edges which right otherwise scratch the soiled surface or cut the user. In a preferred form, the sheet 26 is 4 mils thick or greater. The sheet 26 may comprise a liquid impervious coating formed over the rear surface of the blotter layer 24.

The packet means 28 comprises a plurality of pouches 50 disposed longitudinally along the sheet 26 at a location intermediate the sheet 26 and the rear surface 36 of the scrubber layer 22. The pouches have outer walls 52 of liquid impervious material, such as a laminate of outer 48 gauge polyester, and inner layers comprising a coextrusion of low density polyethylene and ethyl vinyl acetate, a peelable coating, such as a material sold under Code No. QM 6224 by American Can, Greenwich, Conn. This material provides a barrier to moisture loss of preferably 3% or less per year, and also provides a barrier to perfume loss. The pouches 50 contain a liquid cleaning or active material 54 of suitable type to clean various soiled surfaces, such as no-wax floors, counter tops, appliances, ceramic tiles, glass, or bathroom fixtures. In one form, the cleaning material 54 comprises an all-purpose cleaner such as a cleaner sold under the trademark Ajax Lemon Fresh at end use level by Colgate-Palmolive Company, New York, N.Y. The pH of the cleaning solution is generally alkaline in the range of 7 to 11. In a preferred form, the pouches 50 have chambers 56 with a volume in the range of 20 to 100 cc. The outer wall 52 facing the scrubber layer 22 has a line 57 of weakness, such as a score line, such that the pouches 50 consistently break along a predetermined cross section to release all of the cleaning material 54 into the scrubber layer 22. In a preferred form, the liquid material 54 in the pouches 50 project one foot beyond the pouch position during rupture, and saturate the scrubber layer 22. However, too much headspace (air) in the chambers 56 causes the liquid to project further than the desired distance of one foot. The quantity of air in the chambers 56 affects the velocity at which the liquid material 54 is dispensed, since the applied pressure causes compression of the air in the chambers 56. Thus the preferred amount of air inside the pouches 50 should be 20% or less of the volume of the chambers 56. The burst pressure of the pouches 50 should be in the range of 20 to 30 pounds/square inch, and it is important to the consumer that the pouches 50 consistently rupture at the same pressure level. At the same time, the pouches 50 should be able to withstand shipping and warehousing conditions, and the product package for the pads 20 prevent premature rupture of the pouches 50. The pouches 50 are sufficiently thin to provide the scrubber layer 22 with a generally planar front surface 34 both before and after rupture of the pouches 50 to facilitate scrubbing by the scrubber layer 22. Another example of suitable pouches for use in the pad 20 are disclosed in U.S. Pat. No. Pike 3,608,709, incorporated herein by reference.

A further example of the packet means 28 for the pad 20 is illustrated in FIGS. 14 and 15, in which like reference numerals designate like parts. In this embodiment, the pouch 50 has first and second layers 114 and 116 of the above described material sealed around four sides 118*a*, 118*b*, 118*c*, and 118*d*, with the three sides 118*a*, *b*, and *c* having strong seals, and the side 118*d* having a weak seal. The weak seal is accomplished by using a lower sealing temperature, pressure, and/or dwell time, and the weak seal area of side 118*d* is thinner than the other three seals of sides 118*a*, *b*, and *c*. The sealed layers 114 and 116 define a chamber 56 to retain the cleaning material 54. When pressure is applied to the pouch 50, the side 118*d* comprising the weak seal ruptures to direct forward and downward movement of the cleaning material in the pad 20.

Another embodiment of the packet means 28 for the pad 20 is illustrated in FIGS. 16 and 17 in which like reference numerals designate like parts. In this embodiment, the pouch 50 has a single layer 120 of the above described material, which is folded along side fold lines 122*a* and 122*b*. The opposed ends 124*a* and 124*b* of the layer 120 are sealed together, and the side edges 126*a* and 126*b* of the layer 120 are sealed together along a seal line 128 which extends between the ends 124*a* and *b*. One of the seals 124*a*, 124*b*, or 128 is weak, while the other two seals are strong, such that the pouch 50 ruptures in the region of the weak seal when pressure is applied to the pouch 50.

The blotter layer 24 has a pair of opposed side edges 58*a* and 58*b*, a pair of opposed end edges 60*a* and 60*b* connecting the side edges 58*a* and *b*, a front surface 62 for contacting the surface to be cleaned, and a rear surface 64 facing the impervious sheet 26. The blotter layer 24 is designed to absorb the dirty liquid residue which was generated by the scrubbing action thus leaving a residue free surface and excellent gloss to the surface. Otherwise, the dirty liquid residue, if not totally removed leaves embedded soil and causes dullness problems with any textured surface, and to some extent with flat hard surfaces also. The blotter layer 24 is a more convenient way of removing dirty liquid rather than rinsing the surface with water. The blotter layer 24 has a high absorptive capacity and rate under pressure. As the user is drying the surface with the blotter layer 24, some pressure is applied to the surface. The absorbed liquid should be retained inside the pad 20 when pressure is applied to cause the pad 20 to easily slide across the surface. The blotter layer 24 also has excellent sliding characteristics across a wet and dry surface, and provides a buffing action. The blotter layer 24 preferably comprises a nonwoven material which is lint and streak free which is a function of the web structure design of the nonwoven material. As an example, the nonwoven material has a basis weight in the range of 15 to 40 grams/square yard, and a fiber blend of polyester/rayon at ratios of 50/50 to 80/20, such as a nonwoven material sold by Thc Kcndall Company, Boston, Mass., under the trademark of Novinette, Code No. 149,022. The nonwoven material is preferably thermally bonded, but can be chemically bonded. As an alternative example, the nonwoven material contains a ratio of hydrophobic to hydrophilic fibers in the range of 50/50 to 80/20, such as a nonwoven sold by Crown Textile, Jenkintown, Pa., with a Code No. PS-0800. The blend of hydrophobic and hydrophilic fibers is selected, since a totally hydrophobic material would leave streaks, and a totally hydrophilic material would absorb liquid, but would not slide properly. Further examples of the blotter layer 24 are absorbent oven textiles, and a suitable absorbent paper material. In one form, as shown in FIG. 9, the pad 20 has a suitable superabsorbent 66, such as a material sold by Grain Processing Corp, of Muscatine, Iowa, under Code No. J500 or J550, disposed adjacent the rear surface 64 of the blotter layer 24 to substantially increase the absorptive capacity of the blotter layer 24.

Referring to FIG. 6, in a preferred form the blotter layer 24 contains an inner core 68 of absorbent fiberized hood pulp, with the core 68 having a front surface 70, and a rear surface 72 facing toward the sheet 26. The core 68 may have a sheet 74 of wadding tissue wrapped around the core 68 with overlapping ends 76 located over the rear surface 72 of the core 68. The wadding sheet 74 serves to stabilize the core 68. As shown, a sheet 78 of nonwoven matcrial is wrapped around the core 68 and wadding sheet 74, with opposed ends 80 of the nonwoven sheet 78 underlying the core 68, and being secured to the impervious sheet 26 by suitable heat sealing or adhesive. The nonwoven sheet 78 may be of the types previously described in connection with the blotter layer 24. In one form, the core 68 has a suitable superabsorbent 82, such as a material sold by Grain Processing, under Code No. J500, located adjacent the rear surface 72 of the core 68 to enhance the absorbent capacity of the blotter layer 24. In any event, the embodiment of the blotter layer 24 shown in FIG. 6 has a high absorptive capacity and rate under pressure. The nonwoven sheet 78 permits passage of soiled liquid through the sheet 78, and it is retained in the core 68, rather than the outer sheet 78.

An alternative embodiment of the core 68 is shown in FIG. 7 in which like reference numerals designate like parts. In this embodiment, the core 68 has lines 84 of embossing in the core, shown in a crossing manner, to enhance fluid spreading in the core 68 along the lines 84. The embossing lines 84 serve to stabilize the core 68, and this core may be utilized with or without the wadding sheet 74.

Another embodiment of the core 68 is illustrated in FIG. 8, in which like reference numerals designate like parts. In this embodiment, the core 68 has a paper-like densified layer 86 adjacent the rear surface 72 of the core 68 which enhances fluid spreading at the rear surface 72 of the core 68. The layer 86 may be constructed by wetting the rear surface 72 of the core 68, and then compressing the core 68. The layer 86 also serves to stabilize the core 68, and the core 68 of FIG. 8 may be utilized with or without the wadding sheet 74.

Another embodiment of the impervious sheet 26 and packet means 28 is illustrated in FIGS. 4 and 5, in which like reference numerals designate like parts. In this embodiment, the sheet 16 has a plurality of cavities 90 disposed longitudinally along the sheet 26, with the cavities 90 having openings 92 facing toward the front surface 42 of the sheet 26. The openings 92 of the cavities 90 are closed by covers 94 which are secured to the front surface of the sheet 26 to close the openings 92. The covers 94 are rupturable when pressure is applied to the rear of the cavities 90 to dispense the liquid cleaning material 54 disposed in the cavities 90 into the scrubber layer 22. The covers 94 may be constructed from a suitable foil or plastic laminate, and may be secured to the sheet 26 by suitable means, such as heat sealing or by adhesive.

In use, the pad 20 is pressed by the hand or foot in the region of the pouches 50 or the cavities 90 in order to cause rupture of the pouches and passage of the cleaning material 54 into the scrubber layer 22 in order to saturate the scrubber layer 22. The wetted scrubber layer 22 may be applied to the soiled surface to be cleaned, and the scrubber layer 22 may be used to scrub the surface while the cleaning material 54 is applied to the surface. During this time, the blotter layer 24 may be grasped by the hand while the impervious sheet 26 prevents wetting of the blotter layer 24 and hand. In this manner, the scrubber layer 22 is utilized to cause mechanical and chemical soil release from the surface.

Once the surface has been scrubbed by the scrubber layer 22, the pad 20 is inverted or turned over to place the blotter layer 24 against the surface to be cleaned. The pad 20 may then be moved by the hand again to absorb the dirty liquid residue by the absorbent blotter layer 24. In this manner, the soil entrapped in valleys of a textured surface is loosened by the scrubber layer 22 in a manner improved over conventional devices, such as sponge mops, and the dirty liquid residue remaining after scrubbing is removed by the blotter layer 24 to prevent problems associated with the textured surface.

A preferred manner of cleaning the soiled surface with the pad 20 is illustrated in connection with FIGS. 10 and 11, in which like reference numerals designate like parts. As shown, an instrument, such as a sponge mop 96, is utilized in conjunction with the pad 20. After rupture of the pouches 50 and placement of the scrubber layer 22 against the soiled surface, the sponge 97 of the elongated mop head 98 is placed against the blotter layer 24, and the handle 100 attached to the head 98 is pushed to cause pressure by the head 98 against the blotter layer 24 and pad 20. The handle 100 is then moved to cause movement and scrubbing by the scrubber layer 22 against the surface S, with the high coefficient of friction between the sponge 97 and blotter layer 24 maintaining the head 98 on the pad 20. The above procedure is illustrated in connection with FIG. 10.

After scrubbing has been completed, the head 98 is removed from the pad 20, and the pad 20 is inverted or turned over to place the blotter layer 24 against the surface S. As illustrated in FIG. 11, the head 98 of the mop 96 is then placed against the scrubber layer 22, and the handle 100 is pressed in order to cause pressure by the head 98 against the pad 20. The handle 100 is then moved to cause movement of the pad 20 along the surface S, and absorption of the liquid residue by the blotter layer 24 while a high coefficient of friction between the scrubber layer 22 and the sponge 97 of the head maintains the head 98 on the pad 20. After blotting of the surface S has been completed, the head 98 is removed from the pad 20, and the used pad 20 is discarded.

Another embodiment of the pad 20 for use in conjunction with the mop 96 is illustrated in FIG. 12, in which like reference numerals designate like parts. In this embodiment the pad 20 has a pair of loops 102 and 104 which may be secured to the sheet 26. The loops 102, and 104 are located adjacent opposed ends 106 and 108, respectively, of the pad 20. The loops 102 and 104 are shown in solid lines in FIG. 12 as overlying the blotter layer 24 in order to releasably receive opposed ends 110 and 112 of the mop head 98, with the head 98 located against the blotter layer 24 in order to utilize the scrubber layer 22 to scrub the soiled surface.

After scrubbing has been completed, the loops 102 and 104 are removed from the mop head 98, and the loops 102 and 104 are inverted to the position shown in dotted lines in FIG. 12 such that they overlie the scrubber layer 22. The ends 110 and 112 of the mop head 98 are received in the loops 102 and 104 in this configuration of the loops 102 and 104, such that the mop head 98 contacts the scrubber layer 22 with the loops 102 and 104 releasably retaining the head 98 in place on the pad 20. In this configuration, the mop 96 is utilized to place pressure against the pad 20 and cause movement of the pad 20 in order to blot the wetted surface. After blotting has been completed, the loops 102 and 104 are removed from the mop head 98, and the pad 20 is discarded.

An embodiment of the sponge mop 96 for use with the pad 20 is illustrated in FIG. 13, in which like reference numerals designate like parts. As shown, the sponge 97 has a pair of spaced circular sections 130 of hook fastening material secured to a front surface 132 of the sponge 97 by suitable means, such as adhesive. The sponge 97 is placed against the scrubber layer 22 and blotter layer 24 which act as loop fastening material, such that the sections 130 of hook fastening material releasably engage the scrubber layer 22 and blotter layer 24 to releasably retain the pad 20 to the sponge 97. The section 130 may comprise hook fastening strips sold under the trademark Velcro, and the scrubber and blotter layers 22 and 24 operate as corresponding loop fastening strips. Of course, the sections 130 may be of any suitable shape at any suitable location on the sponge 97, or may comprise one continuous strip. Further, the pressure applying member contacting the pad need not comprise a sponge, but any suitable device or head holding the sections 130, and preferably having a handle attached to the head for movement and operation of the pad.

A preferred embodiment of the pad 20 of the present invention is illustrated in FIGS. 18–20, in which like reference numerals designate like parts. In this embodiment, the pad 20 has a scrubber layer 22 of the previously described material having side edges 30*a* and *b* and end edges 32*a* and *b* heat sealed to the impervious sheet 26. The pad 20 has a blotter layer 24 comprising an outer nonwoven sheet 78 as previously described having side edges 58*a* and *b* and end edges 60*a* and *b* sealed to the impervious sheet 26. The blotter layer 24 has an inner core 68 of fiberized wood pulp wrapped by a wadding sheet 74, as previously described. The pad 20 has elongated packet means 28 substantially as described in connection with FIGS. 14 and 15. The pouch 50 of this packet means 28 extends substantially the width and length of the impervious sheet 26. The pouch 50 has strong seals at its ends, one strong side seal at side 118*b* and one weak side seal at side 118*d* which ruptures under pressure to provide forward and downward movement of the cleaning material 54 from the pouch 50 in the pad 20.

Another embodiment of the present invention is illustrated in FIG. 21, in which like reference numerals designate like parts. This embodiment is similar to the pad 20 described in connection with FIGS. 1–3, except that the pad 20 does not have pocket means. As before, the pad 20 has a scrubber layer 2, a blotter layer 24, and a liquid impervious sheet 26 intermediate the scrubber layer 22 and blotter layer 24. The scrubber layer 22 can be dry or wet impregnated with the active ingredient or cleaner. In the event that the scrubber layer 22 is dry impregnated with the active ingredient, the user would wet the scrubber layer 22 prior to scrubbing to release the cleaner. If the scrubber layer 22 is wet impregnated, then the liquid cleaner is released as pressure is applied for scrubbing.

A method of cleaning a soiled surface with a pad having a coarse, resilient, porous, flexible scrubber layer and an opposed absorptive blotter layer is disclosed as follows. A liquid cleaning or active material is applied to the surface, the scrubber layer is placed on the surface, and the surface is scrubbed with the scrubber layer to loosen embedded soil. The pad is then inverted, and the blotter layer is placed on the surface. The surface is wiped with the blotter layer to remove dirty liquid residue from the surface.

Another method of cleaning a soiled surface with a pad having a coarse, resilient, porous, flexible scrubber layer and an opposed absorptive blotter layer, and with an instrument having an elongated head and a handle attached to the head is desscribed as follows. A liquid cleaning or active material is applied to the surface, the scrubber layer is placed on the surface, the head is placed on the blotter layer, and the handle is moved while pressing the pad through the head to move the pad and scrub the surface with the scrubber layer and loosen embedded soil. The head is removed from the blotter layer, the pad is inverted and the blotter layer is placed on the surface, the head is placed on the scrubber layer, and the handle is moved while pressing the pad through the head to move the blotter layer along the surface and remove dirty liquid residue from the surface.

Another method of cleaning a soiled surface with a coarse, resilient, porous, flexible scrubber layer, and an absorptive blotter layer is described as follows. A liquid cleaning or active material is applied to the surface, the scrubber layer is placed on the surface, and the surface is scrubbed with the scrubber layer to loosen embedded soil. The scrubber layer is removed from the surface, the blotter layer is placed on the surface, and the surface is wiped with the blotter layer to remove dirty liquid residue from the surface.

For purposes of testing cleaning systems, a lab prototype soil was developed for no-wax floors. The soils were composed of combinations of fats, proteins and/or carbohydrates. Fats are normally deposited on the floor from cooking and frying meats, such as bacon, and the use of cooking oils. Eggs, meat spatterings, as well as milk spills normally provide a source of protein. Sugars and sugar containing products, such as cookies, cakes, juices, sodas, and flour normally provide carbohydrates. Soils were prepared for the test using many ingredients containing fats, proteins and/or carbohydrates. A testing response was obtained from using the following mixture, identified as soil 9495-93A, which showed noticeable differences between the cleaning methods used.

| Ingredients | Wt. % |
|---|---|
| Cooking/Salad Oil (Wesson, Mazzola, Puritan) | 41.7 |
| No-wax floor cleaner sold by Johnson under the trademark Brite | 33.3 |
| Water, deionized | 10.8 |
| Sugar, white granulated | 5.8 |
| Piscataway clay from New Jersey | 8.3 |

The cleaner Brite gives the soil mixture more flow during application andprovides more adhesion to the surface. As this soil ages, it becomes more tenacious and this is shown in the following results.

| | % Soil Removed | | |
|---|---|---|---|
| | Cleaning System | | |
| After Aging | W | D | C |
| Day 1 | 93 | 97 | 97 |
| Day 2 | 100 | 100 | 100 |
| Day 3 | 97 | 100 | 100 |
| Day 6 | 48 | 52 | 100 |
| Day 8 | 0 | 4 | 61 |
| Day 10 | 0 | 0 | 50 |
| Day 13 | 0 | 0 | 28 |
| Day 15 | 0 | 0 | 32 |

Test Parameters

| | |
|---|---|
| Substrate: | Mannington Marquis 971 no-wax flooring |
| Soil 9495-93A: | Applied by paint roller; air-dried 1 hour; surface soil removed by wiping with paper towels; soil in valleys aged at room temperature as indicated before washing |
| Instrumental Readings: | Photovolt before and after soiling and after each washing interval, as determined by Model No. 670 of Photovolt Corp., which measures reflectance |
| Test Systems: | W - Sponge and Water |

-continued

| After Aging | % Soil Removed Cleaning System W | D | C |
|---|---|---|---|
| | D - Sponge, diluted all purpose cleaner, and rinse<br>C - Invention: diluted all purpose cleaner, nonwoven scrubber layer, and separate absorbent blotter layer | | |
| # Strokes: | 10 wash, 5 rinse or 5 dry | | |
| Wash Frequency: | After 1, 2, 3, 6, 8, 10, 13 and 15 days aging. | | |

The soil cures in about 6–8 days at room temperature, and is then ready to use. The test results for % Soil Removal clearly indicate the superiority of the invention system over the conventional sponge mop system (D), and the wash system (W).

Also, a test was conducted with 92 homemakers using the pad of the present invention on dirty no-wax floors. It was found that 82% of the panelists found the cleaning system of the present invention better than their usual method of cleaning. The panelists cited the convenience of the present system as being most important, such as ease of use, saving time and a no-mess situation, such as no bucket and water required, and the lack of wet hands during use.

The foregoing detailed description is given for clearness of understanding only, and no unnecessary limitations should be understood therefrom, as modifications will be obvious to those skilled in the art.

We claim:

1. A cleaning device, comprising:

a pad having a scrubber layer of porous material, a liquid impervious sheet or surface substantially covering a rear surface of scrubber layer, a blotter layer of absorptive material extending over the sheet of surface on a side opposite the scrubber layer, and rupturable packet means containing a liquid active material associated with the scrubber layer; and an instrument having a head attached to an elongated handle, said pad having fastening means for releasable attachment of the head to the scrubber layer and blotter layer, said fastening means comprising a pair of loops fixedly attached to opposed ends of the pad to releasably receive the head, said loops being invertible between a position overlying the scrubber layer to a position overlying the blotter layer, such that the scrubber layer or blotter layer may be attached in close engagement to the head.

* * * * *